US005751569A

United States Patent [19]

Metel et al.

[11] Patent Number: 5,751,569

[45] Date of Patent: May 12, 1998

[54] GEOGRAPHIC TRAIN CONTROL

[75] Inventors: Omer Metel; Francois Pretorius, both of Rancho Cucamonga, Calif.

[73] Assignee: Safetran Systems Corporation, Minneapolis, Minn.

[21] Appl. No.: 617,469

[22] Filed: Mar. 15, 1996

[51] Int. Cl.[6] ..... B61L 21/00; B61L 27/00

[52] U.S. Cl. ..... 364/132; 701/1; 701/19; 701/36; 701/117; 246/3; 246/5

[58] Field of Search ..... 364/131, 132, 364/424.024, 424.045, 423.098; 246/167 R, 20, 219, 3, 5, 124, 131; 701/117, 1, 19, 23, 29, 36, 940, 962, 964

[56] References Cited

U.S. PATENT DOCUMENTS

| | | | |
|---|---|---|---|
| 3,794,977 | 2/1974 | Thorne-Booth et al. | 340/163 R |
| 3,836,768 | 9/1974 | Clarke et al. | 246/3 |
| 3,976,272 | 8/1976 | Murray et al. | 246/5 |
| 4,122,523 | 10/1978 | Morse et al. | 364/436 |
| 4,284,256 | 8/1981 | Norton | 246/5 |
| 4,323,210 | 4/1982 | Elder | 246/26 |
| 4,641,243 | 2/1987 | Hartkopf et al. | 364/132 |
| 5,006,847 | 4/1991 | Rush et al. | 246/3 |
| 5,301,906 | 4/1994 | Bodnar, II | 246/3 |
| 5,420,883 | 5/1995 | Swensen et al. | 375/200 |

*Primary Examiner*—James P. Trammell
*Assistant Examiner*—Bryan Bui
*Attorney, Agent, or Firm*—Dorn, McEachran, Jambor & Keating

[57] ABSTRACT

The invention relates to a method of controlling railroad train movement over a layout of railroad track that is defined geographically using a linear network of geographic control objects which includes signals, switches and track blocks. Each signal has signal control hardware and software logic, which logic includes an address, representation of signal condition, and the ability to initiate a change in signal condition. Each switch has switch control hardware and software logic, which logic includes an address, representation of switch condition, and the ability to initiate a change in switch condition. Each track block has hardware and software logic, which logic includes an address and a representation of track block occupancy condition. The method is specifically directed to establishing communication between each signal logic, switch logic, and track logic, and only its next adjacent logic neighbors regardless of whether it be signal logic, switch logic, or track logic. Such communication is limited to one of a plurality of predetermined messages, which messages either request a response relating to train movement or provide a response relating to train movement.

7 Claims, 1 Drawing Sheet

GEOGRAPHIC TRAIN CONTROL

THE FIELD OF THE INVENTION

The present invention relates to a method for controlling railroad train movement over a layout of railroad track that is defined geographically and represented by a linear network of control objects. The control is provided by uniquely limiting communication to that between adjacent control objects (signals, switches and track blocks) in the layout, and further limiting such communication to one of a plurality of predetermined messages.

The control of train movement through a track layout (typically consisting of switches, signals and track circuits), often referred to as an interlocking, has gone through several stages of evolution. Initially, such control may have been derived from a tower adjacent to the interlocking in which, once the desired path of train movement had been determined, the dispatcher would mechanically connect the various switches and signal controls within the interlocking so that nothing could be altered during the passage of train movement. Subsequently, multi-arm relays replaced the mechanical levers in the dispatcher's tower, with the relays being interconnected in such a way that once a desired path of train movement had been determined and the appropriate signals applied to the relays, no change in a signal or switch could take place until train movement was complete.

In later developments, the relays would be controlled, not from a dispatcher's tower, but from a remote location such as a central train control office (CTC). In this instance, the central train control office would send out a control signal, either over pole lines adjacent the right of way, or by some other means of distance communication such as radio, and the relays would be operated in accordance with a predetermined logic (unique per interlocking) so that passage of train movement would be permitted without interruption. Such a control required command communication between the CTC office and all of the switches, signals, and track blocks (via the relays) and a logic interconnection between the control objects within the path of train movement. The command communication is done using non-vital requests from the CTC office. The logic interconnection between the control objects is done via relay contacts. Subsequently, the relays were replaced with solid state logic, such as microprocessors, but the basic concept remained the same. The system was cumbersome to the extent that each desired path of movement required relay or Boolean logic which included the condition of every signal, switch and track block within the desired path of movement.

The present invention provides a very substantially simplified system for train control in which a desired path for train movement is determined by requesting clearance through the entering point of a geographic network of geographic control objects representing the track layout, with all subsequent communication being between each geographic control object in the network and only its next adjacent objects. Such communication is limited to predetermined messages, the end result of which is to provide permission for the train to pass through the described route, but without the necessity of custom designed logic relating all geographic control objects within the path of movement.

SUMMARY OF THE INVENTION

The present invention relates to a method of train control in which each geographic control object (signals, track blocks and switches) communicates with only its neighboring such objects using a standard predetermined set of system messages.

Another purpose is a method as described in which each geographic control object (signal, track block or switch) functions without any knowledge of the overall architecture of the railroad and communicates only with its next adjacent neighbors.

Another purpose is a train control process as described which may be distributed (not requiring a single central processing unit), therefore lending itself to localized testing when a failed hardware module is replaced, as only the function performed by that module need be tested.

Another purpose is a signal control system as described in which each geographic control object, signal, track, or switch is generic and only differs from similar objects within the system by its unique address.

Another purpose is a signal control system as described which eliminates the necessity to prepare custom logic, either relay or Boolean, for each geographic control object installation.

Another purpose is a geographical railroad signal control system in which maintenance personnel do not need to understand fundamental signalling principles and which system may be designed, installed, configured and commissioned using relatively unskilled personnel without compromising safety.

Another purpose is a control system as described in which the geographic control object hardware and software logic may be positioned at trackside as part of the physical appliance (e.g. switch machine) it controls, eliminating the need for buildings along the right of way.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The present invention provides a method or process or system for railroad train control over a geographically defined layout. In the past, such train control required a central processing unit (or relay logic) which would be in command communication with each control object, whether it be signal, switch, or track block, within the layout and there was the necessity of preparing custom logic (either relay or Boolean) for each such object. The need for defining the relay or Boolean logic and the need for customizing it for each installation, as well as the command communication requirements between the CPU (or relays) and each such installation, placed a heavy burden on railroad signal engineers, equipment manufacturers and train control dispatchers. Further, when a failure occurred, for example in the microprocessor of the CPU at an interlocking, or the microprocessor at any location within the system, extensive testing was required to meet FRA (Federal Railway Administration) requirements when the microprocessor was replaced.

The present invention provides a substantially simplified train control system. It is no longer necessary to prepare custom logic, either relay or Boolean, for each interlocking. Each geographic control object, whether it be signal, switch, or track block, only communicates with its next adjacent neighbors, as defined by a network of geographic control objects within the interlocking. This communication is only in a predetermined series of messages. Such messages, along with the described limited communication, provide all of the control necessary to have train movement through a track layout.

The invention will be described in connection with a passing siding and a train which is to move through this interlocking. Four messages will be described which are sufficient to effect train control through the described layout. It should be understood that in more complex geographical layouts, there may be a number of additional messages required. However, the principle will remain the same; i.e., there is only communication between each geographic control object and its next adjacent neighbors, and such communication will only be in one of a defined series of predetermined messages.

Each geographic control object is generic in the sense that its hardware/software logic is standard. The logic for each geographic control object, whether it be signal, switch, or track block, only differs from a like object by its individual address and by the addresses of its next adjacent neighbors with which it can communicate.

Figure 2:
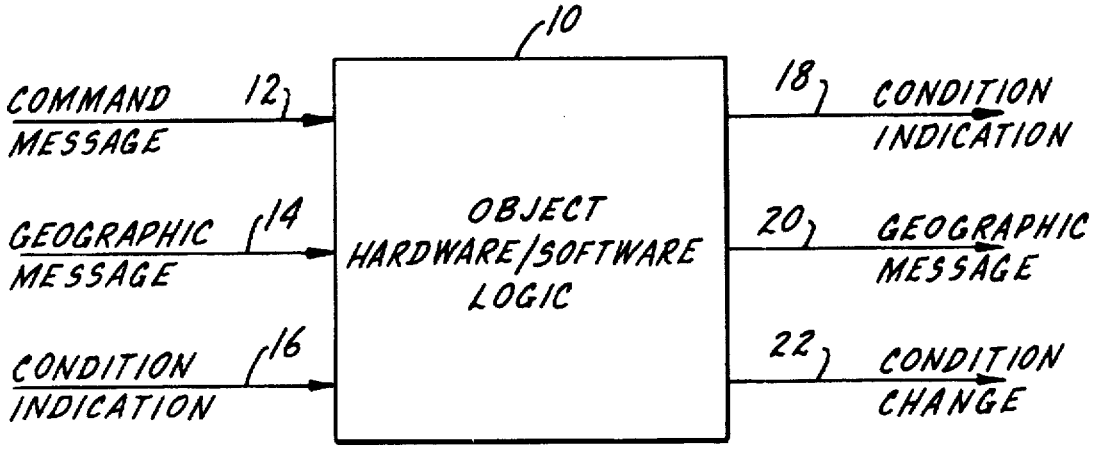
FIG. 2 is a diagrammatic illustration of the geographic control object hardware/software logic which may be used with a signal, switch or track block.

Focusing on FIG. 2, which represents a typical geographic control object hardware/software input and output connections, this geographic control object may represent a signal, a switch, or a track block. There is hardware and software in the geographic control object which has the address of the object and the addresses of the next adjacent neighbors; programmed messages which may be sent out; and the ability to determine which message will be sent out in response to a received message taking into consideration the condition of the geographic control object which is receiving the message.

Typically, each message will be digital and in standard ATCS format (a communication protocol specified by the Association of American Railroads (AAR) for Advanced Train Control Systems) and will include the address to whom the message is to be sent, a data portion and a verification portion. Such may include an address portion with up to 104 bits, as the address must indicate the railroad, the geographic position in the railroad where the geographic control object is located, the specific hardware module and then the specific geographic control object within the hardware. In such instances where a signal, switch, and/or track block all have a common location, the hardware and software logic may be physically at one location, or in one module, but will have certain portions of the total hardware/software logic of the module dedicated to each of the geographic control objects at that location.

The geographic control object 10 of FIG. 2 may receive a command message at input 12 from a CTC which in the example to be described may be the request for a signal to be cleared for train movement. A second input 14 is for a geographic message which would be the message which the geographic control object would receive from its next adjacent neighbor. The third input 16 would be for an indication of the condition of the geographic control object itself.

The geographic control object has three possible outputs. A first output 18 is a condition indication which would be sent back to the CTC. The second output 20 is a geographic message which would be sent by the geographic control object to one of its next adjacent neighbors, and the third output 22 would be a command to change condition of the geographic control object, whether it be the movement of switch points or the change of an aspect of a signal. Neighboring geographic control objects, whether in a common module or physically separated, will typically communicate by exchanging a standard set of high level ATCS messages which will be exchanged on a change of state basis when there is no request for train movement and on a repeated basis when route locking or protection is in effect. The messages may be sent over any type of communication network, such as land line, coaxial cable, fiber optic cable, or radio.

Although the invention will be described in connection with four specific messages, it is within the scope of the invention to use a substantial number of additional messages depending upon the requirements for train movement through a defined geographical layout. For example, the invention will be described in connection with a double-ended siding which does not require "return to train" signal aspects. This function, as well as others, can be implemented by defining additional messages which would be added to the predetermined messages per geographic control object.

The four types of messages to be described will include a lock request (LR), which is issued in the direction of intended train movement to lock the subroute (route which will take the train to the next governing signal) that is currently defined by certain switch settings. For example, a signal geographic control object will issue a lock request out of the head neighbor connection (side of the object adjacent to signal head as opposed to signal base) when the signal is clear requested. A lock request will initiate other geographic messages, such as protect requests and protect grants, necessary to protect the route from conflicting movements, i.e. to block opposing signals. Regardless of any conflicting conditions that will prevent a subroute from being established, a lock request will propagate in the direction of intended movement to the end of the subroute—a signal geographic control object in the direction of intended movement or an end of block geographic control object (used to define end of signalled territory).

A lock grant (LG) is issued by a geographic control object against the direction of intended movement in response to a lock request. A lock grant is confirmation that a subroute is locked and protected. A lock grant will propagate against the direction of intended movement to the origin of the corresponding lock request. A lock grant will not propagate past a condition that should prevent the subroute from being established (e.g. a switch that is not in position, or an occupied track block).

A protect request (PR) is typically triggered by a lock request. Geographic control objects will issue a protect request against the direction of conflicting movement to seek protection from approaching trains (i.e. to block opposing signals). A protect request will propagate until it reaches a geographic control object that is able to provide the necessary protection.

A protect grant (PG) is issued by a geographic control object in the direction of conflicting movement in response to a protect request. A protect grant is confirmation to the receiving geographic control object that some other geographic control object is providing protection from movements in the direction of the protect grant. A protect grant will propagate in the direction of conflicting movement to the origin of the protect request. Geographic control objects will not propagate a protect grant if conditions make it impossible to protect the route (e.g. an occupancy in the direction of the protect grant). A signal geographic control object is considered blocked (i.e. the signal cannot be cleared) if it is issuing a protect grant out of its head neighbor connection.

Figure 1:
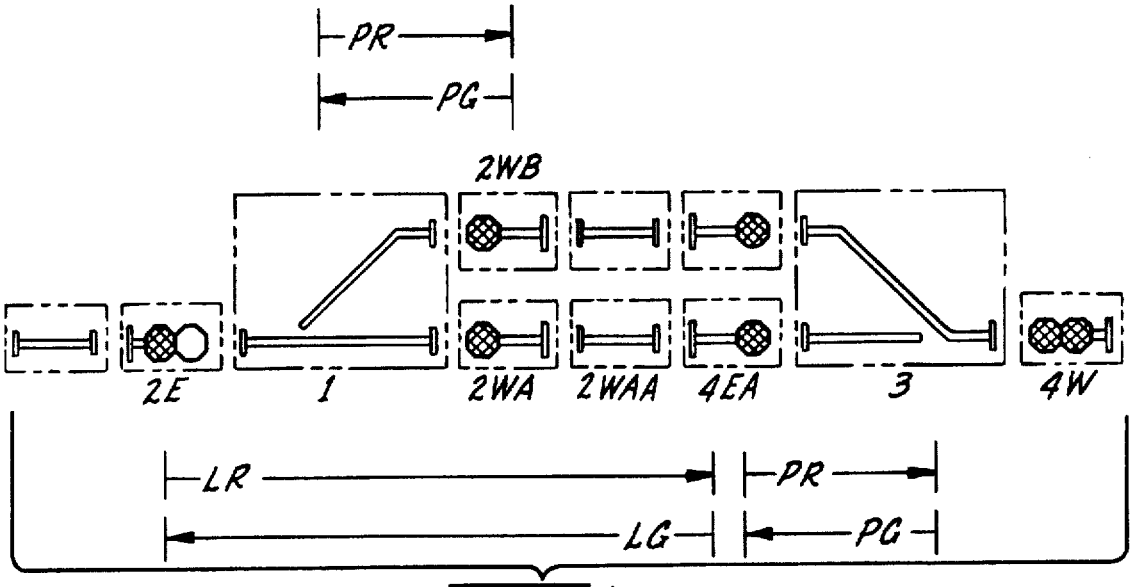
FIG. 1 is a diagrammatic illustration of a typical railroad interlock.

The following description relates to the layout of FIG. 1 and will define how the four described messages are used in clearing a signal to permit train movement from left to right. The described sequence to clear a signal is the same whether the signal be controlled or automatic. If controlled, the signal will receive a clear request from the CTC office; if automatic, the signal will receive a clear request from an adjacent signal by means of a lock request.

When signal 2E is clear requested, it will issue a lock request to switch 1. Switch 1 will issue a protect request to signal 2WB and a lock request to signal 2WA. The purpose of the lock request is to lock the rest of the subroute and the purpose of the protect request is to seek protection against conflicting movements. Switch 1 will not respond to any command from the CTC to move as long as it is receiving a lock request.

Since signal 2WB is at stop for right to left movement, it will answer the protect request from switch 1 with a protect grant. Signal 2WB is now blocked and it may not be cleared. Signal 2WB will remain blocked as long as it is issuing a protect grant and signal 2WB will continue to issue the protect grant as long as it is receiving a protect request.

Signal 2WA is not qualified to respond to the lock request from switch 1, since it is controlling right to left train movement. The lock request will thus be passed from signal 2WA to track block 2WAA and from the track block to signal 4EA. Because signal 4EA is the end of the subroute, it can issue a lock grant but first must receive a protect grant against conflicting train movement. A protect request is sent from signal 4EA to switch 3 and since it is set to prevent movement toward the signal, it issues a protect grant. When signal 4EA receives a protect grant from switch 3, it will answer the lock request from track block 2WAA with a lock grant. When track block 2WAA receives the lock grant from signal 4EA, it will answer the lock request from signal 2WA with a lock grant, assuming track 2WAA is not occupied. When signal 2WA receives a lock grant from track 2WAA, it will answer the lock request from switch 1 with a lock grant. When switch 1 receives a lock grant from signal 2WA, having already received a protect grant from signal 2WB, it will answer the lock request from signal 2E with a lock grant which will then clear signal 2E.

As can be seen, with the use of only four types of messages, and with the response to each message being determined by the condition of the geographic control object and its location relative to the requested clearance, it is possible to control train movement through the described interlock. Each geographic control object only communicates with its neighboring geographic control object, without ever knowing the type of geographic control object with which it is communicating. The messages are predetermined, the messages are limited in geographic extent to the next adjacent neighbor, and with such a combination of messages and the limit on their propagation, train control is totally effective through the described interlock.

Whereas the preferred form of the invention has been shown and described herein, it should be realized that there may be many modifications, substitutions and alterations thereto.

The embodiments of the invention in which an exclusive property or privilege is claimed are defined as follows:

1. A method of controlling railroad train movement over a geographically defined network of geographic control objects which represent a layout of railroad track which includes signals, switches and track blocks, each signal having signal control hardware and software logic, which logic includes an address, representation of signal condition, and means for initiating a change in signal condition (signal object logic), each switch having switch control hardware and software logic, which logic includes an address, representation of switch condition, and means for initiating a change in switch condition (switch object logic), each track block having hardware and software logic, which logic includes an address and representation of track block occupancy condition (track object logic), each object logic including the addresses of only its next adjacent neighboring objects.

the method including the steps of establishing communication between each signal object logic, switch object logic, and track object logic and only its next adjacent object's logic regardless whether it be signal object logic, switch object logic, or track object logic, with such communication being one of a plurality of predetermined messages, which messages either request a response relative to train movement, or provide a response relating to train movement.

2. The method of claim 1 wherein one of said predetermined messages is a lock request asking permission to send a train in the direction of intended movement to the next adjacent neighboring object.

3. The method of claim 2 wherein one of said predetermined messages is a lock grant granting permission to send a train toward the object sending the lock grant.

4. The method of claim 3 wherein one of said predetermined messages is a protect request asking a next adjacent object logic to block train movement toward the sending object.

5. The method of claim 4 wherein one of said predetermined messages is a protect grant advising a next adjacent object logic that train movement in its direction has been blocked.

6. The method of claim 1 in which each message includes an address portion and a message portion.

7. The method of claim 6 wherein each message includes a verification portion.

* * * * *